United States Patent [19]

Cubbison, Jr.

[11] Patent Number: 4,862,315

[45] Date of Patent: Aug. 29, 1989

[54] STATIC ELECTRIC DISCHARGE APPARATUS

[75] Inventor: Richard J. Cubbison, Jr., Westminster, Colo.

[73] Assignees: American Telephone and Telegraph Company, New York, N.Y.; AT&T Information Systems Inc., Morristown, N.J.

[21] Appl. No.: 265,152

[22] Filed: Oct. 31, 1988

[51] Int. Cl.[4] ..... H05F 3/02

[52] U.S. Cl. ..... 361/212; 250/251; 600/1; 128/419 N

[58] Field of Search ..... 361/212, 213, 220, 225, 361/229, 230, 231, 232, 223, 224; 174/4 C; 250/251; 128/362, 419 N, 783, 802; 600/1

[56] References Cited

U.S. PATENT DOCUMENTS

| | | | |
|---|---|---|---|
| 3,311,108 | 3/1967 | Cristofv et al. | 361/231 X |
| 3,328,508 | 6/1967 | Ritter | 174/4 C |
| 3,875,461 | 4/1975 | Richardson et al. | 361/230 |
| 3,993,932 | 11/1976 | Weigl | 361/224 |
| 4,048,667 | 9/1977 | Brennecke | 361/213 |
| 4,107,755 | 8/1978 | Kiefer | 361/220 |
| 4,570,200 | 2/1986 | Osada et al. | 361/212 |
| 4,586,106 | 4/1986 | Frazier | 361/212 |
| 4,618,909 | 10/1986 | Sanders | 361/212 |

*Primary Examiner*—L. T. Hix
*Assistant Examiner*—Brian W. Brown
*Attorney, Agent, or Firm*—John C. Moran

[57] ABSTRACT

The cordless static electric discharge unit for discharging static electricity from a human body into the air. The apparatus consists of a discharge unit attached to the wearer's wrist by a wrist strap. The discharge unit utilizes a radioactive source to ionize air and the flow of the ions discharges the human body. If the human body is at a positive potential with respect to ground, the negative ions flow to the human body whereas the positive ions flow from the discharge unit to a grounding point. The discharge unit is mechanically constructed such that sub-atomic particles emitted by the radioactive material are prevented from entering the human body or flowing into the surrounding air.

10 Claims, 1 Drawing Sheet

FIG. 1
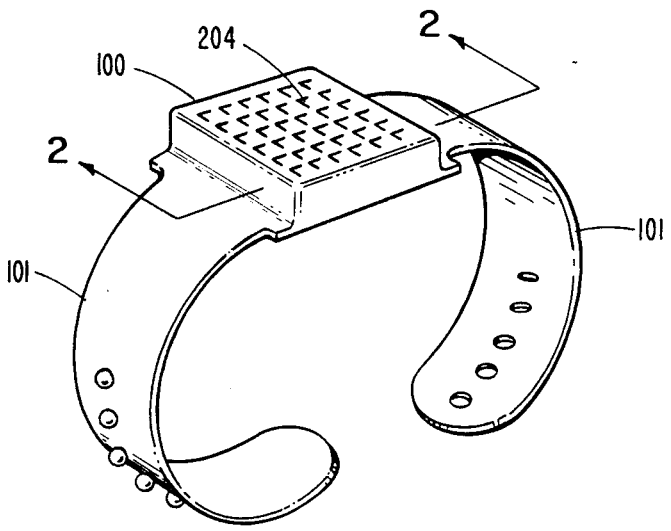
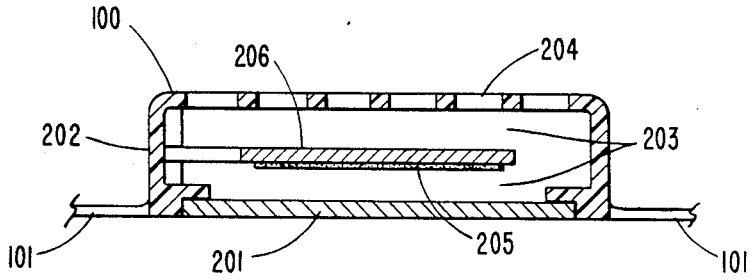
FIG. 2

STATIC ELECTRIC DISCHARGE APPARATUS

TECHNICAL FIELD

This invention relates to the discharging of electrostatic potentials and in particular to the discharging of electrostatic voltages from a human body without the need of physically grounding the human body.

BACKGROUND OF THE INVENTION

In many work environments, the discharge of static electric voltages from a worker's body to equipment or product under manufacture can be hazardous to the worker or may damage the equipment or product. One example of such a hazardous environment is a petrochemical factory where explosive gases may exist. Another example is a munition plant where the workers are directly handling explosive compounds. Also, the average worker in a typical electronics plant can easily damage components by discharging static electricity to these components. This is largely due to the extensive use of MOS integrated circuits which are very sensitive to high voltages. Not only can the high voltage of a static electricity discharge damage these components before being mounted on printed circuit boards, but also after they have been mounted on printed circuit boards.

Existing procedures for eliminating the build-up of static electricity on workers' bodies have been to remove conditions that foster static electric build-up and the grounding of the workers. The problem with attempting to remove the conditions that foster static electric build-up is that it is expensive and in general does not effectively prevent the build-up of static electricity. The problem with grounding the workers is that it is very inconvenient for the workers and limits their mobility. In addition, certain types of worker activities, such as transporting printed circuit cards or racks of equipment throughout a manufacturing plant, do not lend themselves to the grounding of the workers. Another problem with attempting to ground the workers is the problem of the workers forgetting to do so.

SUMMARY OF THE INVENTION

A departure in the art is achieved by an apparatus and method for discharging static electricity from the human body by means of the apparatus which can be worn on the human body and which does not have to have a solid or liquid electrical connection to the human body's environment. The apparatus operates by ionizing a body of air within the apparatus, illustratively by, using a radioactive source to emit sub-atomic particles to ionize the air. One polarity of ions flow to a conductive, illustratively metal, contact which is in contact with the body and the other polarity of ions flow to earth ground through the air.

In an illustrative embodiment of the invention, the apparatus comprises a discharge unit which is held on the wrist of the person by a wrist strap. The discharge unit comprises a structure to which a radioactive coating is applied, and the structure is contained within an ion chamber having plastic walls, a metal bottom and a plastic grill for allowing the free flow of air and ions into and out of the ion chamber. The metal bottom is held in contact with the person via the wrist strap which advantageously may be made out of a conductive material.

In addition, the structure holding the radioactive coating may advantageously be positioned such that the sub-atomic particles strike the metal bottom thus preventing the particles from entering the human body or escaping from the unit. Advantageously, the radioactive coating may be the Americium$^{241}$ isotope.

BRIEF DESCRIPTION OF THE DRAWING

FIG. 1 illustrates an apparatus according to the invention comprising a discharge unit attached to a wrist strap which is designed to be worn on the wrist of a worker; and FIG. 2 illustrates a cross-sectional view of the discharge unit of FIG. 1.

DETAILED DESCRIPTION

FIG. 1 illustrates an apparatus for discharging static electricity from the human body. This apparatus is designed to be worn on a person's wrist and consists of discharge unit 100 and wrist strap 101. However, it would be obvious to one skilled in the art that discharge unit 100 could be worn on the human body other than on the wrist. For example, it could be worn around the ankle as long as the ankle band to which discharge unit 100 was attached was conductive so that discharge unit 100 had an electrical connection to the body. Wrist strap 101 could be a metallic wrist strap such as used in metal expansion bands for wrist watches or it could be a material rendered conductive by metal threads or conductive impregnation as is currently done in conventional wrist straps through which workers are electrically grounded to their work benches.

Discharge unit 100 is shown in greater detail in FIG. 2. Electrical contact is maintained to the person's body through metal body contact 201. Conducting wrist strap 101 would be firmly attached through a variety of mechanical means to contact 201. The sides 202 of the unit are made of plastic. The top of the unit is plastic grill 204 which allows the movement of air ions from ion chamber 203 and air into chamber 203. Radioactive coating 205 is applied to structure 206. The latter structure is made from metal so as to prevent emitted alpha particles from escaping through grill 204. Advantageously, radioactive coating 205 may be the Americium$^{241}$ isotope.

Radioactive coating 205 is constantly emitting alpha particles from structure 206. The alpha particles are emitted from coating 205 and are directed towards metal body contact 201. As these alpha particles penetrate through the air within ion chamber 203, they collide with air molecules, and these collisions result in the formation of positive and negative ion pairs. The human body can either be at a positive or a negative potential above ground. However, for the sake of description, it is assumed that the human body is at a positive potential with respect to ground. The negative ions are attracted to metal body contact 201 whereas the positive ions are repelled out of ion chamber 203 through grill 204 into the air where they eventually drift to a grounding point. As the negative ions are captured by metal body contact 201, the static electricity of the human body is discharged. If the human body is at a negative potential with respect to ground, the flow of ions is reversed.

Advantageously, the positioning of structure 206 is such that the emitted alpha particles terminate their movement through ion chamber 203 in metal body contact 201. This is an important aspect since it eliminates the potential of radioactivity escaping either into the body of the person wearing the unit or into the surrounding environment. As the air is used to form ions, the air supply within ion chamber 203 is replenished by air flowing through grill 204.

While a specific embodiment of the invention has been disclosed, variations in structural detail, within the scope of the appended claims, are possible and are contemplated. There is no intention of limitation to what is contained in the abstract or the exact disclosure as herein presented. The above-described arrangements are only illustrative of the application of the principles of the invention. Other arrangements may be devised by those skilled in the art without departing from the spirit and the scope of the invention.

I claim:

1. Apparatus for the static electric discharge of a human body and which is worn on the human body, comprising:

an electrode adapted to be electrically connected to said human body;

ionization means located in proximity to said electrode for ionizing air in vicinity of said electrode to form pairs of oppositely charged ions; and chamber means for allowing one member of each pair of said ions to be attracted to said electrode to flow to said electrode and the other member of each pair of ions to be repelled by said electrode to flow from said chamber into the surrounding air thereby discharging static electricity from said human body.

2. The apparatus of claim 1 wherein said ionization means comprises a radioactive material for releasing sub-atomic particles to form said ions.

3. The apparatus of claim 2 further comprising metal positioning means oriented within said chamber such that said sub-atomic particles released from said radioactive material travels in a direction towards said electrode; and said electrode comprises a metal material for stopping said sub-atomic particles before the latter enter said human body.

4. The apparatus of claim 3 wherein said radioactive material is Americium$^{241}$ isotope.

5. The apparatus of claim 1 further comprising a wrist strap for securing said apparatus to the wrist of said human body;

and said wrist strap comprising a conductive material thereby increasing the connection to said human body.

6. A method for discharging static electricity from a human body and by use of a discharge unit which is worn on the human body and which consists of ionization chamber, electrode electrically connected to said human body and ionization means, said method comprising the steps of:

ionizing the air in the vicinity of said electrode to form pairs of oppositely charged ions; and allowing one member of each pair of said pairs of ions attracted to said electrode to flow to said electrode and the other member of each pair of said pairs of ions repelled by said electrode to flow from said chamber into the surrounding air thereby discharging static electric from said human body.

7. The method of claim 6 wherein said ionization means is a radioactive coating for releasing sub-atomic particles forming said ions.

8. The method of claim 7 wherein said ionizing step comprises the step of releasing said sub-atomic particles from said radioactive coating to travel only in a direction towards said electrode; and stopping said sub-atomic particles before the latter enter said human body by said electrode material being fabricated from a metal material.

9. The method of claim 8 wherein said radioactive coating is Americium$^{241}$ isotope.

10. The method of claim 6 further comprises the step of securing said discharge unit to the wrist of said human body by a wrist strap.

* * * * *